US007930970B2

(12) United States Patent
Nishikawa et al.

(10) Patent No.: US 7,930,970 B2
(45) Date of Patent: Apr. 26, 2011

(54) CONTROL UNIT FOR WORK MACHINE

(75) Inventors: Hiroyasu Nishikawa, Tokyo (JP); Sei Shimahara, Tokyo (JP); Manabu Nakanishi, Kobe (JP)

(73) Assignee: Caterpillar S.A.R.L., Geneva (CH)

( * ) Notice: Subject to any disclaimer, the term of this patent is extended or adjusted under 35 U.S.C. 154(b) by 574 days.

(21) Appl. No.: 11/997,176

(22) PCT Filed: Feb. 20, 2007

(86) PCT No.: PCT/JP2007/053026

§ 371 (c)(1),
(2), (4) Date: Jan. 29, 2008

(87) PCT Pub. No.: WO2008/015801

PCT Pub. Date: Feb. 7, 2008

(65) Prior Publication Data

US 2009/0090237 A1 Apr. 9, 2009

(30) Foreign Application Priority Data

Jul. 31, 2006 (JP) ..... 2006-208553

(51) Int. Cl.
*F15B 11/10* (2006.01)

(52) U.S. Cl. ..... 91/433

(58) Field of Classification Search ..... 91/433
See application file for complete search history.

(56) References Cited

U.S. PATENT DOCUMENTS 5,218,820 A * 6/1993 Sepehri et al. ..... 91/433
5,261,234 A * 11/1993 Holloway et al. ..... 91/433

FOREIGN PATENT DOCUMENTS

| | | | |
|---|---|---|---|
| JP | 7-35105 | A | 2/1995 |
| JP | 2000-145720 | A | 5/2000 |
| JP | 2001-182100 | A | 7/2001 |
| JP | 2003-106304 | A | 4/2003 |
| JP | 2004-150198 | A | 5/2004 |

* cited by examiner

*Primary Examiner* — F. Daniel Lopez
(74) *Attorney, Agent, or Firm* — McDermott Will & Emery LLP

(57) ABSTRACT

A control unit for a work machine that allows automatically obtaining optimal operability even when the weight of a work arm in the work machine is changed. In a work machine where at least a part of a work arm to be operated by a fluid pressure actuator is provided so as to be replaceable, a control unit for a work machine includes: a pilot-operated control valve that controls the fluid pressure actuator; a proportional solenoid valve that pilot-controls the pilot-operated control valve by a pilot control pressure according to an electrical signal corresponding to a manual operation amount; a measuring means that measures a weight of at least the part of the work arm; and a controller that converts characteristics between the manual operation amount and the pilot control pressure of the proportional solenoid valve to characteristics according to the weight of the work arm measured by the measuring means.

5 Claims, 5 Drawing Sheets

CONTROL UNIT FOR WORK MACHINE

CROSS-REFERENCE TO PRIOR APPLICATION

This is a U.S. national phase application under 35 U.S.C. §371 of International Patent Application No. PCT/JP2007/053026 filed Feb. 20, 2007, and claims the benefit of Japanese Application No. 2006-208553 filed Jul. 31, 2006. The International Application has not yet been published as of the time of this application. However, the content of both applications is incorporated herein in their entireties.

TECHNICAL FIELD

The present invention relates to a control unit for a work machine that controls the pilot control pressure of a pilot-operated control valve by a proportional solenoid valve.

BACKGROUND ART

In a work machine such as a hydraulic excavator provided with a plurality of hydraulic actuators, there exists a hydraulic control unit that is, in order to obtain a fixed operability irrespective of the weight (front weight) of a work arm, structured so as to calculate a flow rate to be distributed from a hydraulic pump to each hydraulic actuator and control the flow rate by a proportional solenoid pressure reducing valve (see Patent Document 1 Japanese Laid-Open Patent Publication No. 2000-145720 ("JP '720"), e.g., Pages 3-4, FIG. 6).

SUMMARY OF THE INVENTION

On the other hand, when an attachment tool to be attached to the front end portion of a work arm of a hydraulic excavator or a special work arm such as a long-reach arm is attached, the work arm increases in weight, so that the following problem losing operability occurs, however, the flow rate distribution control disclosed in JP '720 cannot solve this problem.

That is, for a motion in the antigravity direction such as, for example, a boom-up motion, actuation of a boom cylinder is slowed. In addition, for a motion in the gravity direction such as, for example, a boom-down motion, the boom cylinder operation speed increases, and the boom cylinder may even go out of control.

The present invention has been made in view of such a problem, and an object thereof is to provide, in a work machine that controls the pilot control pressure of a pilot-operated control valve by a proportional solenoid valve, a control unit for a work machine that allows automatically obtaining optimal operability even when the weight of a work arm is changed.

The invention as set forth relates to a control unit for a work machine including: in a work machine where at least a part of a work arm to be operated by a fluid pressure actuator is provided so as to be replaceable, a pilot-operated control valve that controls the fluid pressure actuator; a proportional solenoid valve that pilot-controls the pilot-operated control valve by a pilot control pressure according to an electrical signal corresponding to a manual operation amount; a measuring means that measures a weight of at least a part of the work arm; and a controller that converts characteristics between the manual operation amount and the pilot control pressure of the proportional solenoid valve to characteristics according to the weight of the work arm measured by the measuring means.

The invention as set forth below relates to the control unit for a work machine as set forth above, wherein the measuring means is provided with a pressure sensor that measures a holding pressure of the fluid pressure actuator of the work arm, and the controller is provided with: an automatic stop function to stop the work arm in a fixed holding pressure measurement posture; and a weight calculation function to estimate the weight of the work arm from the holding pressure measured by the pressure sensor in the fixed holding pressure measurement posture.

The invention as set forth below relates to the control unit for a work machine as set forth above, wherein the controller converts an operation table showing the characteristics between the manual operation amount and the pilot control pressure of the proportional solenoid valve to an operation table of characteristics according to the weight of the work arm measured by the measuring means.

The invention as set forth below relates to the control unit for a work machine as set forth above, wherein the controller converts an operation table at a time of attachment of a standard work arm or at a time of attachment of a standard bucket of the proportional solenoid valve to operate the work arm in an antigravity direction to an operation table of characteristics gradually increased so that the pilot control pressure in an intermediate range or less of the manual operation amount is maximized at a rising position of the pilot control pressure.

The invention as set forth in claim 5 below relates to the control unit for a work machine as set forth above, wherein the controller converts an operation table at a time of attachment of a standard work arm or at a time of attachment of a standard bucket of the proportional solenoid valve to operate the work arm in a gravity direction to an operation table of characteristics gradually decreased so as to gradually lower the pilot control pressure in an intermediate range or more of the manual operation amount.

According to the invention as set forth, since the control unit for a work machine includes a measuring means that measures a weight of at least a part of the work arm and a controller that converts characteristics between the manual operation amount and the pilot control pressure of the proportional solenoid valve to characteristics according to the weight of the work arm measured by the measuring means, satisfactory operability can be automatically obtained, in the work machine where the pilot control pressure of the pilot-operated control valve is controlled by the proportional solenoid valve, even when the weight of the work arm or a part thereof is changed.

According to the invention as set forth below, since the controller is provided with: an automatic stop function to stop the work arm in a fixed holding pressure measurement posture; and a weight calculation function to estimate the weight of the work arm from the holding pressure measured by the pressure sensor in the fixed holding pressure measurement posture, the weight of the work arm can be simply estimated only from the holding pressure without detecting the posture of the work arm.

According to the invention as set forth below, since the controller converts an operation table showing the characteristics between the manual operation amount and the pilot control pressure of the proportional solenoid valve to an operation table of characteristics according to the weight of the work arm measured by the measuring means, a calculation that allows automatically obtaining satisfactory operability even when the weight of the work arm or apart thereof is changed can be swiftly carried out by use of this operation table.

According to the invention as set forth below, by converting an operation table at a time of attachment of a standard work arm or at a time of attachment of a standard bucket of the proportional solenoid valve to operate the work arm in an antigravity direction to an operation table of characteristics gradually increased so that the pilot control pressure in an intermediate range or less of the manual operation amount is maximized at a rising position of the pilot control pressure, deepness of an actuation point of the work arm with respect to the manual operation amount can be prevented. That is, an actuation response of the fluid pressure actuator in the antigravity direction relative to the manual operation amount can be sharpened.

According to the invention as set forth below, by converting an operation table at a time of attachment of a standard work arm or at a time of attachment of a standard bucket of the proportional solenoid valve to operate the work arm in a gravity direction to an operation table of characteristics gradually decreased so as to gradually lower the pilot control pressure in an intermediate range or more of the manual operation amount, an excessively great operation speed in the gravity direction due to an increase in the weight of the work arm can be prevented. That is, the operation speed of the fluid pressure actuator can be maintained in a controllable range.

DETAILED DESCRIPTION OF THE INVENTION

Hereinafter, the present invention will be described in detail while referring to an embodiment shown in FIG. 1 to FIG. 5.

Figure 2:
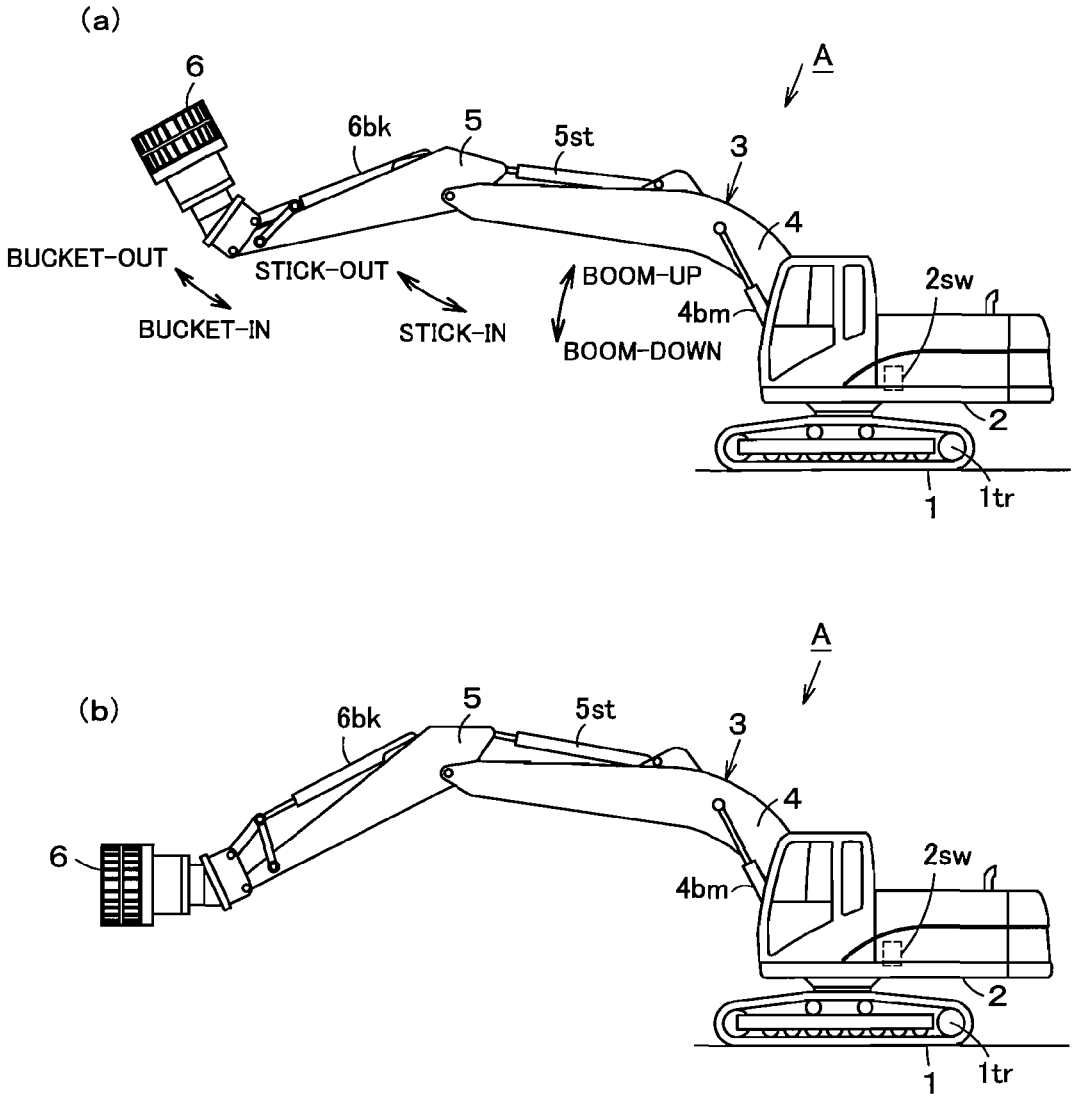
FIG. 2(*a*) is a side view showing a measuring ready posture of a work machine mounted with the same control unit as the above, and (*b*) is a side view showing a holding pressure measurement posture thereof.

FIG. 2 shows a work machine A of a hydraulic excavator type, wherein provided on a lower structure 1 with crawler belts to be driven by a travel motor 1*tr* serving as a fluid pressure actuator is an upper structure 2 to be rotated by a swing motor 2*sw* serving as a fluid pressure actuator, and a work arm (front work equipment) 3 is mounted on this upper structure 2.

For this work arm 3, pivotally supported on the upper structure 2 is a base end portion of a boom 4 to be pivoted in the up-and-down direction by a boom cylinder 4*bm* serving as a fluid pressure actuator, pivotally supported on a front end portion of this boom 4 is a stick 5 to be pivoted in the stick-in/out direction by a stick cylinder 5*st* serving as a fluid pressure actuator, and pivotally supported on a front end portion of this stick 5 is a bucket or an attachment tool 6 to be pivoted in the bucket-in/out direction by a bucket cylinder 6*bk* serving as a fluid pressure actuator. The work arm 3 or the attachment tool 6 being a part of this work arm 3 is provided so as to be replaceable.

Figure 1:
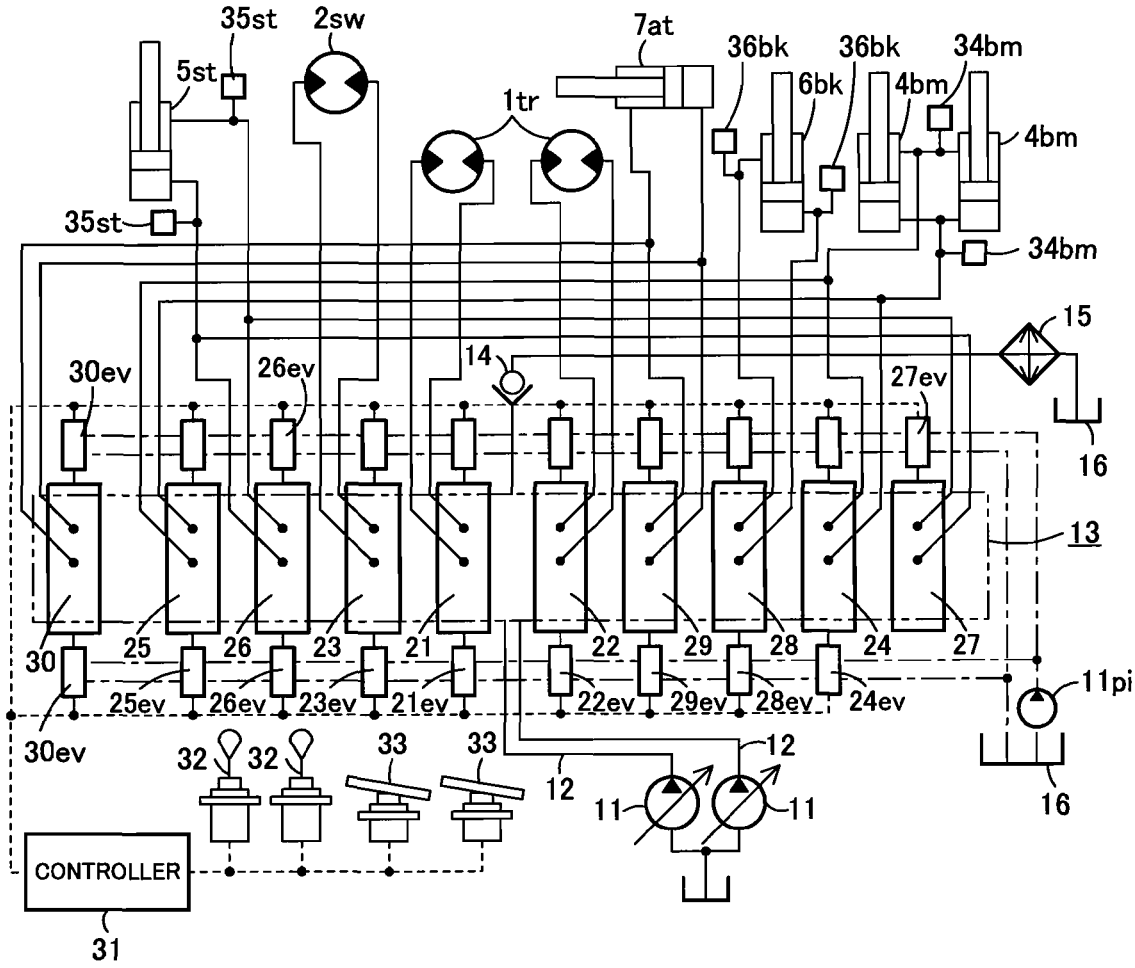
FIG. 1A circuit diagram showing an embodiment of a control unit for a work machine according to the present invention.

FIG. 1 shows a control unit of this work machine A, wherein hydraulic oil feed lines 12 from a plurality of main pumps 11 are connected to a control valve 13, and a return oil discharge port of this control valve 13 is connected to a tank 16 through a check valve 14 and an oil cooler 15. In the control valve 13, incorporated are left and right travel motor spool valves 21 and 22, a swing motor spool valve 23, boom cylinder spool valves 24 and 25, stick cylinder spool valves 26 and 27, a bucket cylinder spool valve 28, and attachment spool valves 29 and 30 that control an attachment actuator 7*at* that operates (for example, opens and closes) the attachment tool 6 serving as pilot-operated control valves that control the abovementioned various fluid pressure actuators.

To one-end portions and the-other-end portions of these various pilot-operated control valves, connected are proportional solenoid valves 21*ev*, 22*ev*, 23*ev*, 24*ev*, 25*ev*, 26*ev*, 27*ev*, 28*ev*, 29*ev*, and 30*ev* (hereinafter, referred to as "21*ev* to 30*ev*") that pilot-control these various pilot-operated control valves by a pilot control pressure (pilot secondary pressure) according to a manual operation amount. To these proportional solenoid valves 21*ev* to 30*ev*, connected are a pilot primary pressure line from a pilot pump 11*pi* and a pilot return oil line to the tank 16, respectively. Here, the proportional solenoid valves include proportional solenoid pressure reducing valves.

Electromagnetic portions of these proportional solenoid valves 21*ev* to 30*ev* are connected to a signal output portion of the controller 31, respectively. To a signal input portion of this controller 31, a working operation lever 32 and a traveling operation pedal 33 to be manually operated by an operator of the work machine A are connected. The operation lever 32 and the operation pedal 33 convert the manual operation amount to an electrical signal and input the electrical signal to the controller 31.

As measuring means that measure the weight of the work arm 3 or attachment tool 6, installed are pressure sensors 34*bm*, 35*st*, and 36*bk* that measure holding pressures of the boom cylinder 4*bm*, the stick cylinder 5*st*, and the bucket cylinder 6*bk* of the work arm 3 on head-side lines and rod-side lines of these fluid pressure actuators, respectively. Here, for a reduction in cost, it is also possible to estimate the weight of the work arm 3, that is, the front weight, or the like even by a measurement at only three points of the head side of the boom cylinder 4*bm*, the rod side of the stick cylinder 5*st*, and the rod side of the bucket cylinder 6*bk*. Signal output portions of the pressure sensors 34*bm*, 35*st*, and 36*bk* are connected to the signal input portion of the controller 31.

The controller 31 is provided with a function to convert characteristics between the manual operation amount and the pilot control pressure of the proportional solenoid valves 21*ev* to 30*ev* to characteristics according to the weight of the work arm 3 measured by the pressure sensors 34*bm*, 35*st*, and 36*bk*.

As a prerequisite therefor, since the holding pressures according to the weight of the work arm 3 are measured by only the pressure sensors 34*bm*, 35*st*, and 36*bk*, it is necessary to measure the work arm 3 in a fixed position, and therefore, the controller 31 is provided with an automatic stop function to stop the work arm 3 in a fixed holding pressure measurement posture and a weight calculation function to estimate the weight of the work arm 3 or attachment tool 6 from the holding pressures measured by the pressure sensors 34*bm*, 35*st*, and 36*bk* in the fixed holding pressure measurement posture.

For example, the automatic stop function is, as shown in FIG. 2(*b*), a function, from a measurement ready posture where the stick cylinder 5*st* and the bucket cylinder 6*bk* of the work machine A are retracted to the maximum, in a measurement mode, when the operation lever 32 is operated in the stick-in direction and the bucket-in direction, in a condition where the pilot control pressure (secondary pressure) from the proportional solenoid valves 26*ev* and 28*ev* and the pump discharge amount (swash plate tilt angle) from the main pump 11 are controlled to predetermined values, to cause a stroke motion of the stick cylinder 5*st* and the bucket cylinder 6*bk* in the stick-in direction and the bucket-in direction for a fixed time and then automatically stop the same, and by this automatic stop function, a fixed holding pressure measurement posture where, as shown in FIG. 2(*b*), the stick cylinder 5*st* and the bucket cylinder 6*bk* of the work machine A are extended by only a fixed distance can be obtained.

Furthermore, the weight calculation function allows estimating the weight of the work arm 3 or the attachment tool 6 from the holding pressures of the boom cylinder 4*bm*, the stick cylinder 5*st*, and the bucket cylinder 6*bk* measured by the pressure sensors 34*bm*, 35*st*, and 36*bk* in this fixed holding pressure measurement posture. For example, since a difference between a head-side pressure and a rod-side pressure of the boom cylinder 4*bm* and a known piston pressure receiving area can indicate a holding force of the boom cylinder 4*bm* and a vector in which the holding force works, a holding force moment of the boom cylinder 4*bm* can be known, in addition, since the fixed holding pressure measurement posture can indicate a center of gravity position of the work arm 3, the weight of the work arm 3 can be calculated from an equation of equilibrium between the holding force moment of the boom cylinder 4*bm* and the center of gravity moment of the work arm 3.

Thus, by changing the posture from the fixed measurement ready posture shown in FIG. 2(*a*) to the fixed holding pressure measurement posture shown in FIG. 2(*b*) and completing a measurement of the respective holding pressures by only the pressure sensors 34*bm*, 35*st*, and 36*bk* attached to the respective rod sides and head sides of the boom cylinder 4*bm*, the stick cylinder 5*st*, and the bucket cylinder 6*bk*, the controller 31 can automatically calculate the weight of the attached work arm 3.

In addition, even without calculation of an accurate front weight, it is also possible to change the operation table by a comparison between the holding pressures at the time of attachment of a bucket and the holding pressures at the time of a change in the front attachment.

Figure 3:
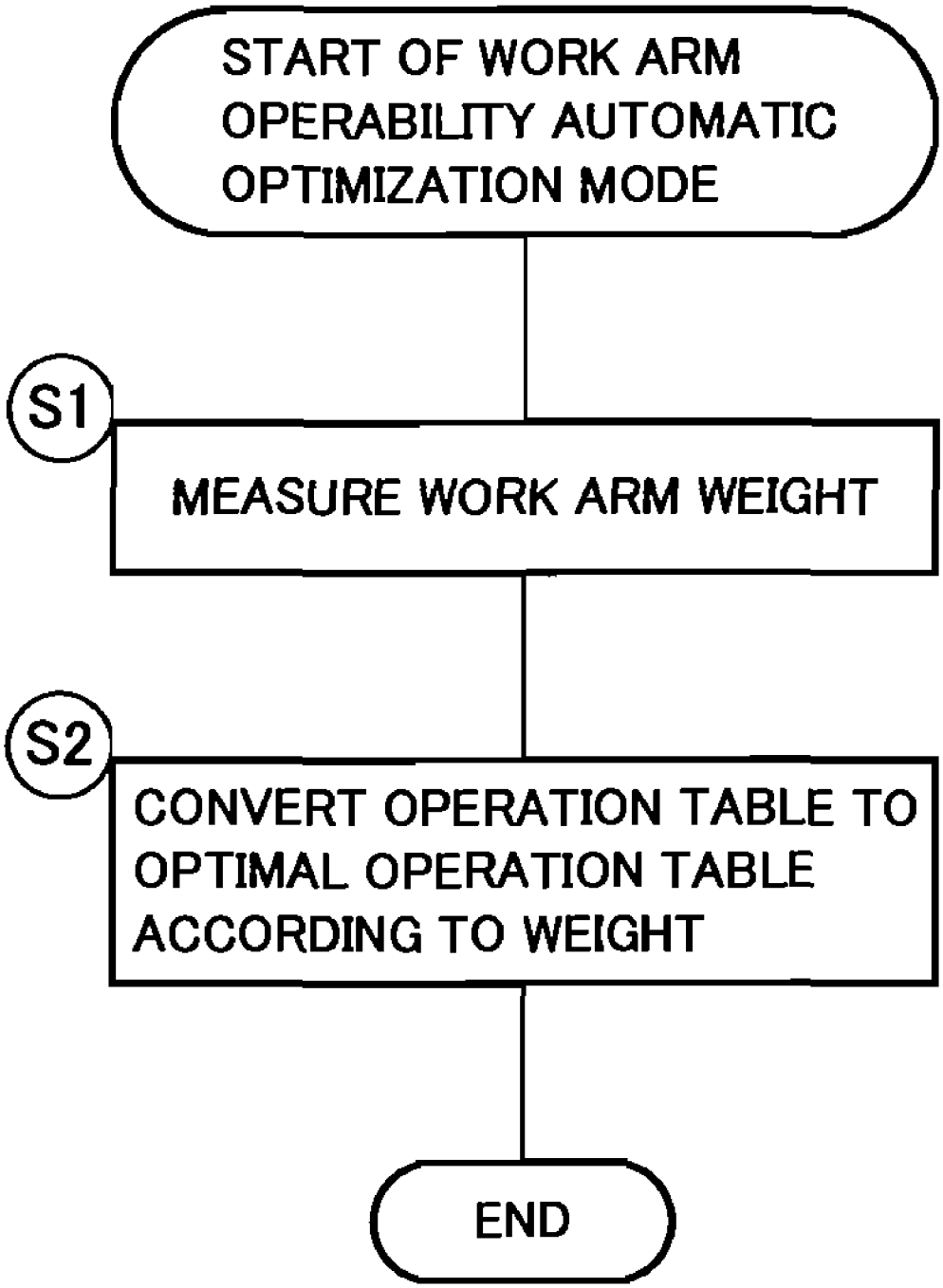
FIG. 3A flowchart showing a control flow of the same control unit as the above.

Next, FIG. 3 shows a control flow of the controller 31, wherein when a work arm operability automatic optimization mode starts, first, when a special work arm (such as a long-reach arm) is attached in place of the standard work arm or the attachment tool 6 is attached in place of the bucket, the weight of the work arm 3 or the attachment tool 6 is measured by the aforementioned weight calculation function (step S1), and next, an operation table at the time of attachment of a standard work arm or at the time of attachment of a standard bucket showing characteristics between the manual operation amount (lever stroke) of the proportional solenoid valves 24*ev*, 25*ev*, 26*ev*, 27*ev*, and 28*ev* and the pilot control pressure (pilot secondary pressure) to an operation table of optimal characteristics according to the weight (step S2).

Figure 4:
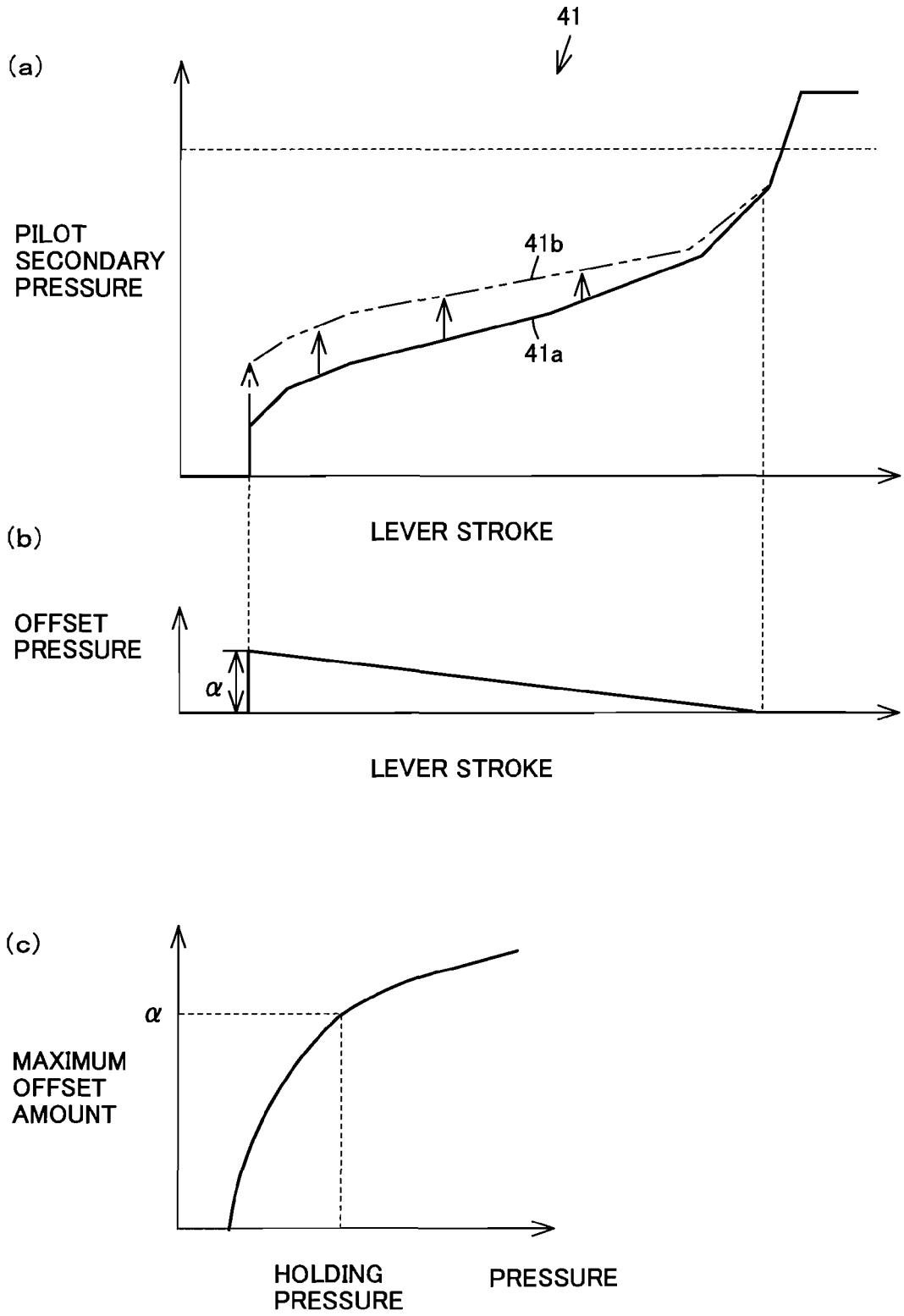
FIG. 4(*a*) is a characteristic diagram showing lever stroke/pilot secondary pressure (pilot control pressure) characteristics as an operation table in the case of an antigravity-direction motion of the same control unit as the above, (*b*) is a characteristic diagram showing lever stroke/offset pressure characteristics thereof, and (*c*) is a characteristic diagram showing holding pressure/maximum offset amount characteristics thereof.
Figure 5:
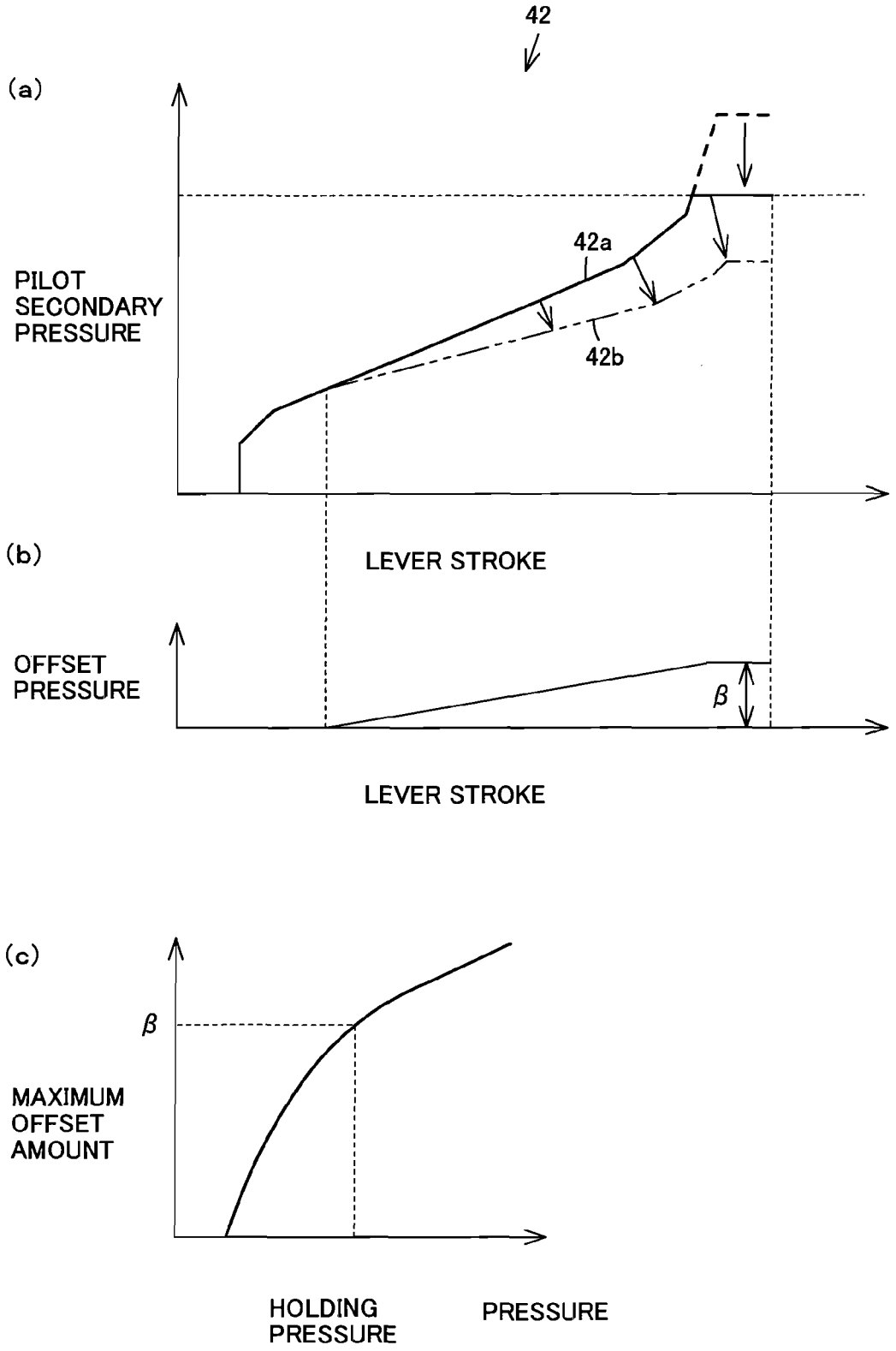
FIG. 5(*a*) is a characteristic diagram showing lever stroke/pilot secondary pressure (pilot control pressure) characteristics as an operation table in the case of a gravity-direction motion of the same control unit as the above, (*b*) is a characteristic diagram showing lever stroke/offset pressure characteristics thereof, and (*c*) is a characteristic diagram showing holding pressure/maximum offset amount characteristics thereof.

That is, the controller 31 is, as shown in FIG. 4(*a*) and FIG. 5(*a*), provided with a function to convert an operation table at the time of attachment of a standard work arm or at the time of attachment of a standard bucket showing characteristics between the manual operation amount (lever stroke) of the proportional solenoid valves 24*ev*, 25*ev*, 26*ev*, 27*ev*, and 28*ev* and the pilot control pressure (pilot secondary pressure) to an operation table of characteristics according to the weight of the work arm 3 or the attachment tool 6 measured by the pressure sensors 34*bm*, 35*st*, and 36*bk* and calculated by the controller 31.

Here, the operation table means lever operation amount/spool operation amount control pressure characteristics, and an electrical control-type hydraulic excavator can easily change these characteristics as long as this controls the spool operation amount control pressure of the boom cylinder spool valves 24 and 25, the stick cylinder spool valves 26 and 27, and the bucket cylinder spool 28 by the proportional solenoid valves 24*ev*, 25*ev*, 26*ev*, 27*ev*, and 28*ev*.

Next, an operation table converting method for a conversion to an operation table according to the work arm weight calculated from the measured holding pressures will be described separately on each motion of the work arm 3. Here, the maximum offset amount means a maximum displacement from a standard position (angle) of the work arm 3, and the maximum offset amount increases in conjunction with the holding pressures as the weight of the work arm 3 increases.

First, FIG. 4 shows an Operation Table 41 in the case of an antigravity-direction motion such as a boom-up motion and a stick-out motion, wherein the controller 31 determines, as shown in FIG. 4(*c*), from a holding pressure/maximum offset amount characteristic curve calculated by an actual-machine measurement, a maximum offset amount $\alpha$ at the measured holding pressure, calculates, as shown in FIG. 4(*b*), gradual decreasing lever stroke/offset pressure characteristics from an offset pressure $\alpha$ corresponding to this maximum offset amount $\alpha$, and adds, as shown in FIG. 4(*a*), these lever stroke/offset pressure characteristics to the lever stroke/pilot secondary pressure (pilot control pressure) characteristics.

Thereby, characteristics 41*a* of the Operation Table 41 of the proportional solenoid valves 24*ev*, 25*ev*, 26*ev*, and 27*ev* to operate the work arm 3 in the antigravity direction can be converted to characteristics 41*b* gradually increased so that the pilot control pressure in the intermediate range or less of the lever stroke (manual operation amount) is maximized at a rising position of the pilot control pressure, and this conversion can increase the pilot control pressure up to the intermediate range, realize a cylinder actuation position equivalent to that of a standard machine, and eliminate the conventional drawback of deepness of a work arm actuation point with respect to the lever operation amount.

In addition, FIG. 5 shows an Operation Table 42 in the case of a gravity-direction motion such as a boom-down motion, a stick-in motion, and a bucket-in motion, wherein the controller 31 determines, as shown in FIG. 5(*c*), from a holding pressure/maximum offset amount characteristic curve calculated by an actual-machine measurement, a maximum offset amount $\beta$ at the measured holding pressure, calculates, as shown in FIG. 5(*b*), gradual increasing lever stroke/offset pressure characteristics from an offset pressure $\beta$ corresponding to this maximum offset amount $\beta$, and subtracts, as shown in FIG. 5(*a*), these lever stroke/offset pressure characteristics from the lever stroke/pilot secondary pressure (pilot control pressure) characteristics.

Thereby, characteristics 42*a* of the Operation Table 42 of the proportional solenoid valves 24*ev*, 25*ev*, 26*ev*, 27*ev*, and 28*ev* to operate the work arm 3 in the gravity direction can be converted to characteristics 42*b* gradually decreased so as to gradually lower the pilot control pressure in the intermediate range or more of the lever stroke (manual operation amount), and this conversion can decrease the pilot control pressure in the intermediate range or more, control the spool moving amount, restrict the cylinder speed to that of a standard machine, and eliminate the conventional drawback of an excessive great cylinder speed due to an increase in the work arm weight.

Next, effects of an illustrated embodiment will be described.

Since the pressure sensors 34*bm*, 35*st*, and 36*bk* being measuring means that measure the weight or at least a part of the work arm 3 and the controller 31 that converts characteristics between the manual operation amount and the pilot control pressure (pilot secondary pressure) of the proportional solenoid valves 24*ev*, 25*ev*, 26*ev*, 27*ev*, and 28*ev* to characteristics according to the weight measured by the pressure sensors 34*bm*, 35*st*, and 36*bk* are provided, in the work machine where the pilot control pressure of pilot-operated control valves 24, 25, 26, 27, and 28 is controlled by the proportional solenoid valves 24*ev*, 25*ev*, 26*ev*, 27*ev*, and 28*ev*, satisfactory operability can be automatically obtained even when the weight of the work arm 3 or a part thereof is changed.

Since the controller 31 is provided with an automatic stop function to stop the work arm 3 in a fixed holding pressure measurement posture and a weight calculation function to estimate the weight of the work arm 3 from the holding pressures measured by the pressure sensors 34*bm*, 35*st*, and 36*bk* in the fixed holding pressure measurement posture, the weight of the work arm 3 can be simply estimated only from the holding pressures without detecting the posture of the work arm 3.

Since the controller 31 converts an Operation Table 41 or 42 at the time of attachment of a standard work arm or at the time of attachment of a standard bucket showing characteristics between the manual operation amount and the pilot control pressure of the proportional solenoid valves 24*ev*, 25*ev*, 26*ev*, 27*ev*, and 28*ev* to an operation table according to the weight of the work arm 3 measured by the pressure sensors 34*bm*, 35*st*, and 36*bk*, a calculation that allows automatically obtaining satisfactory operability even when the weight of the work arm 3 or a part thereof is changed can be swiftly carried out by use of this operation table.

By converting the characteristics 41*a* of the Operation Table 41 at the time of attachment of a standard work arm or at the time of attachment of a standard bucket of the proportional solenoid valves 24*ev*, 25*ev*, 26*ev*, and 27*ev* to operate the work arm 3 in the antigravity direction to the characteristics 41*b* gradually increased so that the pilot control pressure in the intermediate range or less of the manual operation amount is maximized at a rising position of the pilot control pressure, deepness of an actuation point of the work arm 3 with respect to the manual operation amount can be prevented. That is, an actuation response of the fluid pressure actuators 4*bm* and 5*st* in the antigravity direction relative to the manual operation amount can be sharpened.

By converting the characteristics 42*a* of the Operation Table 42 at the time of attachment of a standard work arm or at the time of attachment of a standard bucket of the proportional solenoid valves 24*ev*, 25*ev*, 26*ev*, 27*ev*, and 28*ev* to operate the work arm 3 in the gravity direction to the characteristics 42*b* gradually decreased so as to gradually lower the pilot control pressure in the intermediate range or more of the manual operation amount, an excessively great operation speed in the gravity direction due to an increase in the work arm weight 3 can be prevented. That is, the operation speed of the fluid pressure actuators 4*bm*, 5*st*, and 6*bk* can be maintained in a controllable range.

Thus, an automatic optimization system can be provided, which makes it possible, even when being applied to an electrical control-type hydraulic excavator and attached with any attachment tool or special work arm, to automatically obtain optimal operability, which can control, even for a motion in the gravity direction, for example, a boom-down motion, the boom cylinder operation speed to a restricted speed, and which can make, for a motion in the antigravity direction, for example, a boom-up motion, actuation of the boom cylinder responsive.

The present invention can be applied to a work machine such as a hydraulic excavator or a loader.

The invention claimed is:

1. A control unit for a work machine comprising:

in a work machine where at least a part of a work arm to be operated by a fluid pressure actuator is provided so as to be replaceable, a pilot-operated control valve that controls the fluid pressure actuator;

a proportional solenoid valve that pilot-controls the pilot-operated control valve by a pilot control pressure according to an electrical signal corresponding to a manual operation amount;

a measuring device that measures a weight of at least a part of the work arm, comprising:

a pressure sensor measuring a holding pressure of the fluid pressure actuator of the work arm; and a controller converting characteristics between the manual operation amount and the pilot control pressure of the proportional solenoid valve to characteristics according to the weight of the work arm measured by the measuring device, the controller comprising:

an automatic stop function to stop the work arm in a fixed holding pressure measurement posture; and a weight calculation function to estimate the weight of the work arm from the holding pressure measured by the pressure sensor in the fixed holding pressure measurement posture.

2. The control unit for a work machine as set forth in claim 1, wherein the controller converts an operation table showing the characteristics between the manual operation amount and the pilot control pressure of the proportional solenoid valve to an operation table of characteristics according to the weight of the work arm measured by the measuring device.

3. A control unit for a work machine comprising:

in a work machine where at least a part of a work arm to be operated by a fluid pressure actuator is provided so as to be replaceable, a pilot-operated control valve that controls the fluid pressure actuator;

a proportional solenoid valve that pilot-controls the pilot-operated control valve by a pilot control pressure according to an electrical signal corresponding to a manual operation amount;

a measuring device that measures a weight of at least a part of the work arm; and a controller converting characteristics between the manual operation amount and the pilot control pressure of the proportional solenoid valve to characteristics according to the weight of the work arm measured by the measuring device, wherein the controller converts an operation table showing the characteristics between the manual operation amount and the pilot control pressure of the proportional solenoid valve to an operation table of characteristics according to the weight of the work arm measured by the measuring device, and wherein the controller converts an operation table at a time of attachment of a standard work arm or at a time of attachment of a standard bucket of the proportional solenoid valve to operate the work arm in an antigravity direction to an operation table of characteristics gradually increased so that the pilot control pressure in an intermediate range or less of the manual operation amount is maximized at a rising position of the pilot control pressure.

4. The control unit for a work machine as set forth in claim 3, wherein the controller converts the operation table at a time of attachment of a standard work arm or at a time of attachment of a standard bucket of the proportional solenoid valve to operate the work arm in a gravity direction to an operation table of characteristics gradually decreased so as to gradually lower the pilot control pressure in the intermediate range or more of the manual operation amount.

5. A control unit for a work machine comprising:

in a work machine where at least a part of a work arm to be operated by a fluid pressure actuator is provided so as to be replaceable, a pilot-operated control valve that controls the fluid pressure actuator;

a proportional solenoid valve that pilot-controls the pilot-operated control valve by a pilot control pressure according to an electrical signal corresponding to a manual operation amount;

a measuring device that measures a weight of at least a part of the work arm; and a controller converting characteristics between the manual operation amount and the pilot control pressure of the proportional solenoid valve to characteristics according to the weight of the work arm measured by the measuring device, wherein the controller converts an operation table showing the characteristics between the manual operation amount and the pilot control pressure of the proportional solenoid valve to an operation table of characteristics according to the weight of the work arm measured by the measuring device, and wherein the controller converts an operation table at a time of attachment of a standard work arm or at a time of attachment of a standard bucket of the proportional solenoid valve to operate the work arm in a gravity direction to an operation table of characteristics gradually decreased so as to gradually lower the pilot control pressure in an intermediate range or more of the manual operation amount.

* * * * *